US006260786B1

(12) United States Patent
Ueyama

(10) Patent No.: US 6,260,786 B1
(45) Date of Patent: Jul. 17, 2001

(54) WINDER FOR SHEET MATERIAL

(75) Inventor: Minoru Ueyama, Katano (JP)

(73) Assignee: Fuji Tekko Co., Ltd., Katano (JP)

( * ) Notice: Subject to any disclaimer, the term of this patent is extended or adjusted under 35 U.S.C. 154(b) by 0 days.

(21) Appl. No.: 09/436,896

(22) Filed: Nov. 9, 1999

(51) Int. Cl.[7] ..... B65H 18/10; B65H 19/26; B65H 19/30

(52) U.S. Cl. ..... 242/527.2; 242/531; 242/533; 242/547

(58) Field of Search ..... 242/527.2, 527.3, 242/527.4, 531, 531.1, 541.4, 541.5, 541.6, 541.7, 542.3, 547, 533, 533.1, 533.2, 533.7

(56) References Cited

U.S. PATENT DOCUMENTS

| | | | | |
|---|---|---|---|---|
| 2,663,511 | * | 12/1953 | Stevens | 242/531 |
| 4,374,575 | * | 2/1983 | Lerch et al. | 242/530 |
| 4,431,142 | * | 2/1984 | Kataoka | 242/533.3 |
| 4,697,755 | * | 10/1987 | Kataoka | 242/541.1 |
| 5,620,151 | * | 4/1997 | Ueyama et al. | 242/530 |

* cited by examiner

*Primary Examiner*—John M. Jillions
(74) *Attorney, Agent, or Firm*—Flynn, Thiel, Boutell & Tanis, P.C.

(57) ABSTRACT

A two-shaft linear motion type winder for winding up a sheet material, e.g. a film is provided, which can eliminate the occurrence of any mechanical loss by simplification of a transission device, shorten the path distance of the film upon roll changing, prevent the neck-in and wrinkling of the film and reduce vastly the roll changing cycle. It comprises at least a pair of upper-stage winding frames having holders for an upper winding shaft, suspended from an upper main frame to be slidingly movable back and forth in a given area; and a pair of lower-stage winding frames having holders for a lower winding shaft, disposed on a lower main frame to face upwards so as to be slidingly movable longitudinally in a given area. The holders for the upper and lower winding shafts are capable of ascending and descending vertically; and each of the upper-stage and lower-stage winding frames, upon full winding, move the one winding shaft with a full roll from a winding position to a removal position of the roll while shifting the other winding shaft to the winding position thereby enabling the roll changing; each of the frames and holders being movable individually without mutual interference.

3 Claims, 7 Drawing Sheets

FIG.5B PRIOR ART
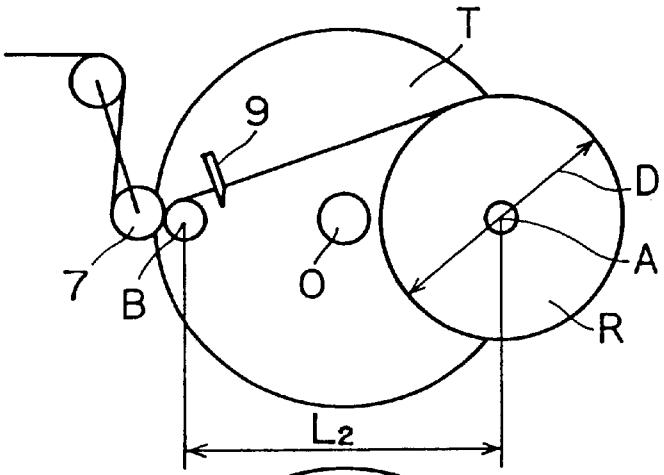
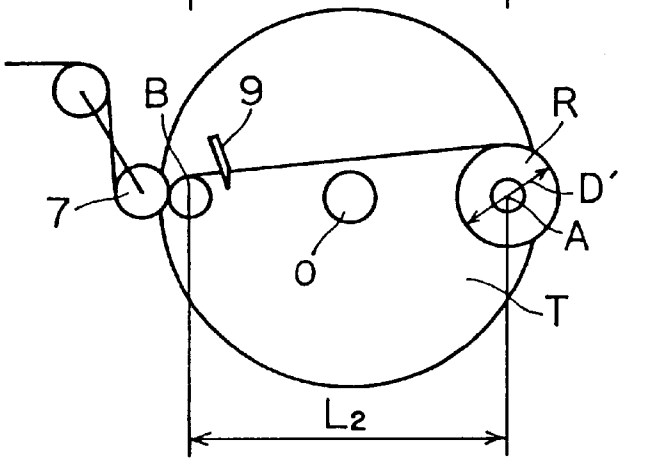
FIG.5D PRIOR ART
FIG.5A
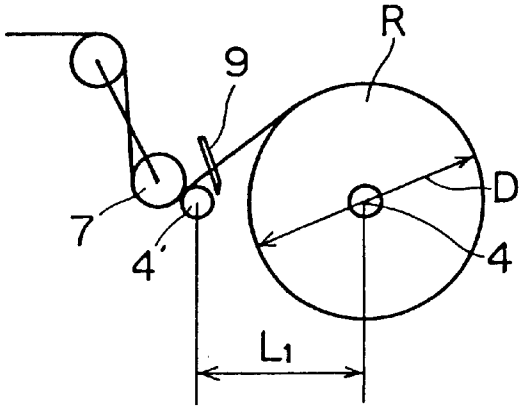
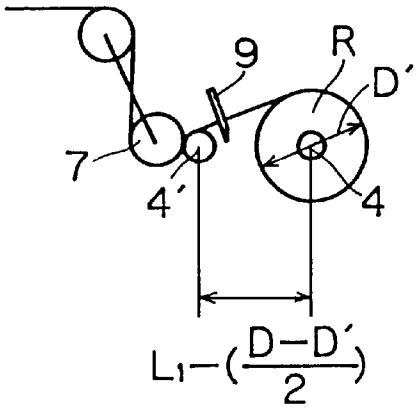
FIG.5C

WINDER FOR SHEET MATERIAL

BACKGROUND OF THE INVENTION

1. Field of the Invention

This invention relates to a winder for a sheet material such as a film or the like, and more particularly, to a multi-shaft linear motion type winder for winding up a film or the like without using a turret.

2. Description of the Related Art

When a film being fed from the film making step is wound up on a winding core in a given length, roll changing is performed from the core having thereon the wound-up film to a new winding core.

Hitherto, a two-shaft (A,B) turret T as shown in FIGS. 4A to 4D, on which one shaft with fully-wound roll and the other shaft for a new winding core are installed together, or a multishaft turret has been used, and consequently, the roll changing work has been conducted by turning the turret T every time the winding process is finished.

That is, in the state illustrated in FIG. 4A, a shaft A is in the course of winding while a shaft B is being attached with a new winding core. A film F is wound via a guide roller onto a winding core on the shaft A by reason of a contact pressure of a touch roller 7. When the winding core of the shaft A is nearly fully wound thereon, the turret T is revolved as shown in FIG. 4B and a new core on the shaft B is shifted to a winding position. At that time, a cutting blade 9 is lowered to sever the film running between the shaft A and the shaft B, and the leading end of the film is wrapped around the new core on the shaft B. The winding-up process to the shaft A is thus stopped (FIG. 4C). Then, when a winding process to the new core on the shaft B is started, a new core is attached to the shaft A (FIG. 4D). In this way, one cycle of the winding process on the conventional turret is completed and the roll changing work for the next winding cycle is initiated.

With the foregoing winding that the roll changing work is conducted by the use of a turret, however, the size of the turret to be used is determined by a distance between centers of the winding shafts, depending upon the winding diameter of a roll, and hence, the higher the winding diameter is, the bigger the size of the turret. As a consequence, the winding machine is inevitably large-sized as the winding diameter is larger, and the production cost is vastly increased, as well.

Further, when the distance between the winding shafts is larger, the path length of the film upon roll changing is longer, which is responsible for the occurrence of neck-in and wrinkling of a film susceptible to extension. Again where the distance between the winding shafts is larger, the moving distance of a new winding core upon roll changing is larger, and consequently, it is difficult to change over to a next winding in a short cycle.

As for the aspect of transmissions of the turret lathe system, because the winding shafts are disposed inside the turret lathe and winding motors for respective shafts are installed outside the winding frame, their powers are necessitated to be transmitted to the winding shafts, relaying a main shaft of the turret during turning. This requires a large-sized tranmission device, brings about a large loss in the revolution mechanism, and raises a big problem in the control of transmission torques required for the winding shafts.

In order to cope with the aforesaid difficulties encountered in the conventional winder, the present invention has been accomplished by finding a linear motion type winder based on a different idea from the conventional turret system. Accordingly, it is an essential object of the invention to provide such a linear motion type winder that winding shafts can move linearly fore-and-aft and up-and-down and independently to the extent that no mutual interference is involved. A more particular object of the invention is to provide a linear motion type winder that enables it to eliminate the mechanical 1088 by simplifying the transmission device, to make the film path length upon roll changing shorter, to avoid the neck-in and wrinkling of an extensible film, and to diminish significantly the cycle of roll changing operations.

SUMMARY OF THE INVENTION

The invention for attaining the aforementioned objects resides in a two-shaft linear motion type winder for winding up a film or the like which comprises:

at least an upper main frame and a lower main frame disposed in a diametrically opposed manner at a required distance spaced apart; a pair of upper-stage winding frames provided with holding members for holding an upper winding shaft therebetween to be capable of ascending and descending vertically, each upper-stage winding frame being suspended from the upper main frame to be at least slidingly movable along the upper main frame in the frontward and backward directions between a winding position and a removal position of a full roll; a pair of lower-stage winding frames provided with holding members for holding therebetween a lower winding shaft to be capable of ascending and descending vertically, each lower-stage winding frame being disposed on the lower main frame to face upwards so as to be at least slidingly movable along the lower main frame in forward and backward directions between the winding position and the roll removal position, the upper-stage and lower-stage frames and the holding members for the upper and lower winding shafts being respectively located to be individually movable back and forth, and up and down without interfering with each other; a touch roller disposed in the vicinity of the winding position so that upon full winding, the full roll on the one winding shaft may be moved by press contact with the touch roller from the winding position to the removal position while the other winding shaft is moved to the winding position, thereby to attach a new winding core; and a cutting blade, disposed between the touch roller and the winding shaft during winding, with which to sever the film running between the full roll and the new core, concurrently while wrapping a leading end of the film around the new core.

Operation of the Winder

With the winder pertaining to this invention, the winding work is carried out in accordance with the following operation:

The winder is based on a different system from a turret system firstly in that two winding shafts move straightforwardly fore and aft and ascend and descend up and down independently to the extent that they don't interfere with each other.

Further, upon roll changing to a next winding, for instance, where the lower-stage winding shaft is in the course of winding, the upper-stage winding shaft holds a next winding core. And when fully wound up, the lower-stage winding shaft retreats and the new winding core on the upper-stage winding shaft begins to advance to come into contact with the film, which is leaving from the core on the lower-stage winding shaft, and the cutter, located in the vicinity, cuts the film, whose leading end is wrapped around the new core on the upper-stage winding shaft and whose trailing end is secured around the roll on the lower-stage winding shaft.

The winding core on the lower-stage winding shaft leaves from the cutting position to move an area in which the new core on the upper-stage winding shaft can move to the winding position. The winding on the lower-stage winding shaft is thus stopped.

Then, winding on the upper-stage winding shaft is performed in the same procedure and sequence as described above. Winding is repeated sequentially by means of the upper-stage and lower-stage winding shafts in this way and the film continuously fed is wound up continuously on winding cores.

BRIEF DESCRIPTION OF THE DRAWINGS

This invention will be hereinafter described in more detail with reference to the accompanying drawings, in which:

FIGS. 5A and 5C, and FIG. 5B and FIG. 5D are comparative illustrations showing the film path distance and the size of the machine upon roll changing, for this invention and the turret winder, respectively, with FIGS. 5A and 5B being cases of a large roll diameter and FIGS. 5C and 5D being cases of a small roll diameter;

PREFERRED EMBODIMENTS OF THE INVENTION

Figure 1:
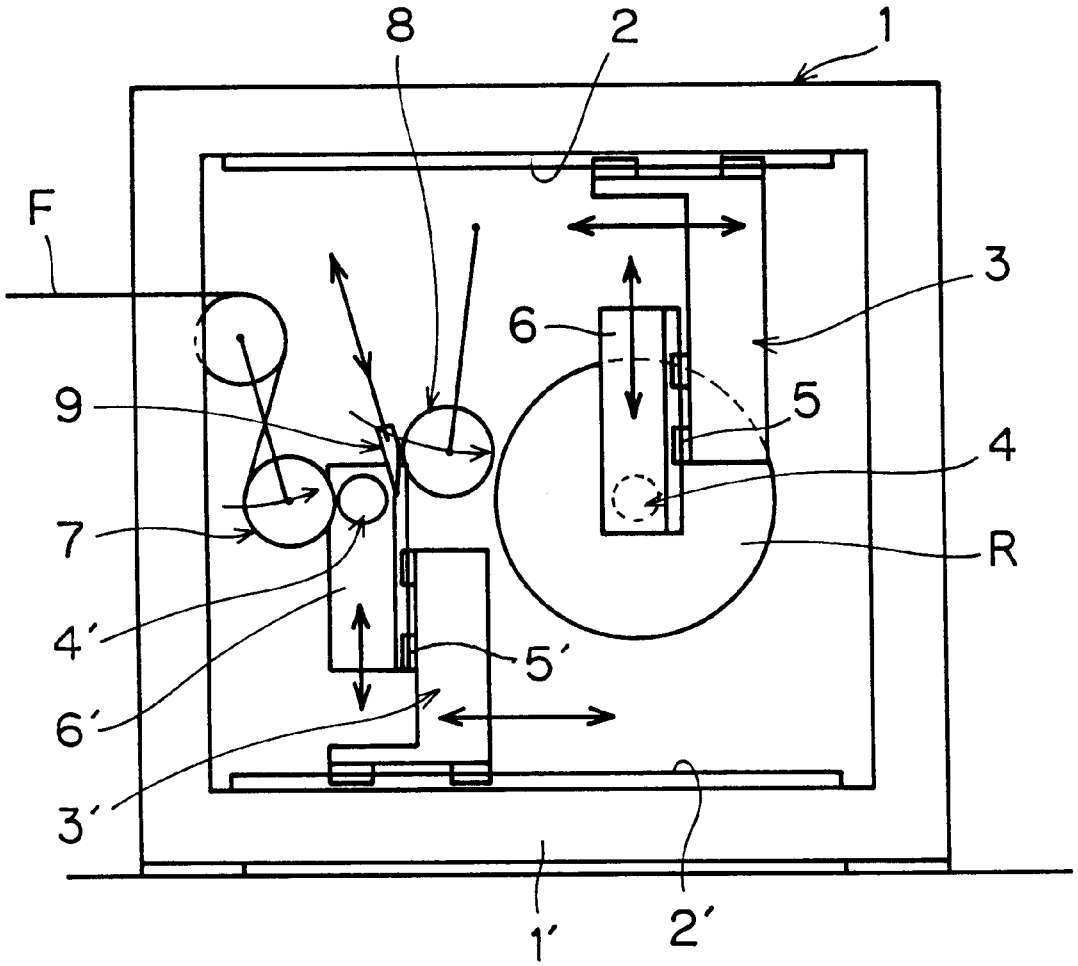
FIG. 1 is a schematic side elevational view of one example of a linear motion type winder according to this invention.
Figure 2:
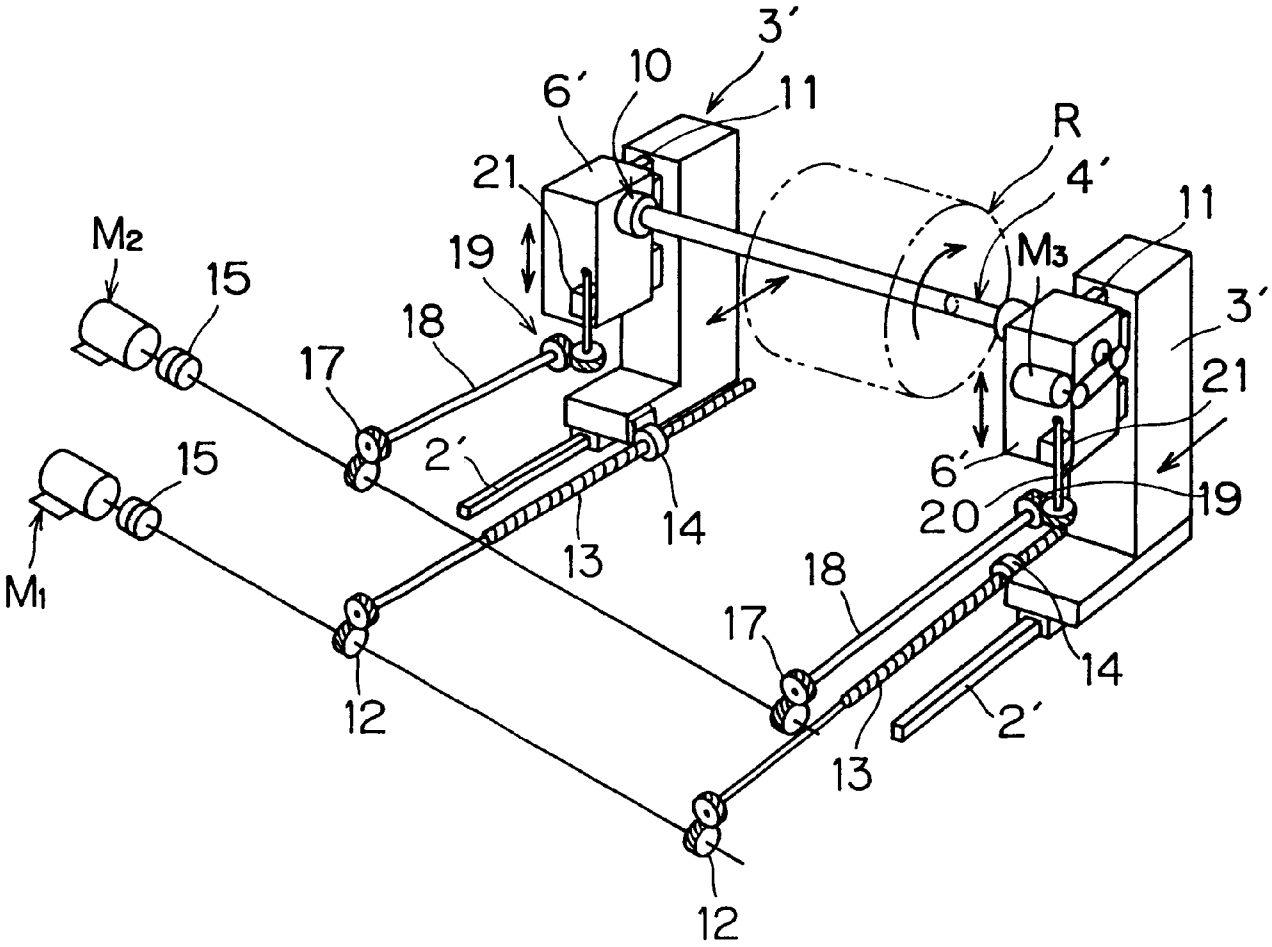
FIG. 2 is an illustration showing a driving system of a lower-stage winding frame section.

Referring to FIGS. 1 and 2, the reference numerals 1,1' designate upper and lower main frames, which are formed integrally as a rectangular frame, as viewed in FIG. 1, and positioned in diametrically opposed manner at a required distance spaced apart. At the inner sides of the upper and lower main frames at the right and left hands, there are disposed linear rails 2,2'. Upper-stage winding frames 3 are disposed to be suspended from the linear rail 2 to be slidingly movable back and forth along the upper main frame 1 at least between a winding position at the left hand in FIG. 1 and a removal position of a full roll at the right hand in FIG. 1 whereas lower-stage winding frames 3' are disposed to face upwards to be slidingly movable back and forth at least between the winding position at the left hand in FIG. 1 and the removal position of a full roll at the right hand in FIG. 1.

The upper-stage winding frames 3 and the lower-stage winding frames 3' are defined with linear rails 11 at their one side, for example, a front side, and provided, through the linear rails 11, with winding shaft-holding parts 6;6' which have winding motors $M_3$ and winding chucks 10 for holding both ends of an upper-stage winding shaft 4 and both ends of a lower-stage winding shaft 4', as partly shown in FIG. 2. Further, sliding mechanisms 5,5' are attached to enable the holding parts 6,6' to be raised and lowered through the linear rails 11 along the winding frames 3,3'.

The movements in the forward and backward directions and in the upward and downward directions of the aforementioned upper and lower winding frames 3,3' and the winding shaft-holding parts 6,6' of the respective frames are enabled by attaching nuts 14 having a threaded bar 13 therethrough; and by constructing the winding frames 3' (as exemplified in FIG. 2) to be slidingly movable through the nuts 14 in a given distance when the threaded bars 13 are rotated via screw gearings 12 from a motor $M_1$ for travelling of the winding frames 3'.

On the other hand, the movement of the upper and lower winding shaft-holding parts 6,6' is performed by means of a series of mechanisms, each unit of which comprises a first screw gearing 17, a second screw gearing 19, a spline shaft 18, a nut 21 and a threaded bar 20. The rotation of a motor $M_2$ is transmitted to the first screw gearings 17 which in turn rotate the spline shafts 18 and the second screw gearings 19 thereby to raise and lower the winding shaft-holding parts 6' fitted with the nuts 21 via the threaded bars 20 and the nuts 21 in a required distance.

The mechanisms for sliding movement and ascending and descending movement are not limited to the aforementioned mechanisms, and suitable other driving means can also be used appropriately.

The foregoing explanation was made with the lower-stage winding frames shown in FIG. 2, but the same is true with the upper-stage winding frames.

Furthermore, the upper and lower winding frames and the winding shaft-holding members as constructed above are designed so that their operations are possible individually without mutual interference in the movement in longitudinal and vertical directions upon roll changing.

In FIG. 1, the reference numerals 7 and 8 designate a first touch roller and a second touch roller, respectively, disposed in the vicinity of the winding position. The first touch roller 7 serves to forcingly abut to a winding shaft (the lower-stage winding shaft 4' in the figure) to wind a film F being fed, whereas the second touch roller 8 serves to forcingly abut to the nearly fully wound roll R in the winding position. A cutting blade 9 for cutting the running film is usually disposed between the second touch roller 8 and the winding shaft 4'.

According to the winder of this invention, it is thus essential that two winding shafts move separately and linearly in forward and backward directions and in upward and downward directions without mutual interference, thereby conducting roll changing work, unlike the turning movement of a turret winder.

Figure 3A:
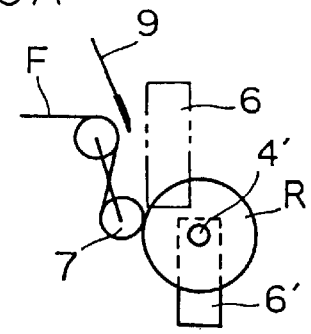
FIG. 3A to FIG. 3I are each an explanatory representation illustrating the roll changing operations in sequence according to this invention.

FIGS. 3A to 3I show one embodiment of the roll changing work in sequential steps. In FIG. 3A, the film F is being wound, under press abutting of the first touch roller 7, onto the winding shaft 4' at the lower-stage winding shaft-holding members 6' while the cutting blade 9 is positioned in the upper position and the upper-stage winding shaft-holding members 6 stand by above the lower-stage winding shaft-holding members 6' without interfering with them.

Figure 3B:
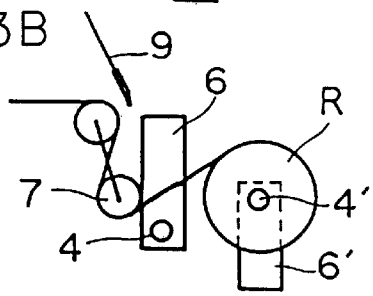
Figure 3C:
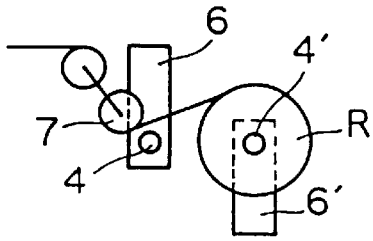
Figure 3D:
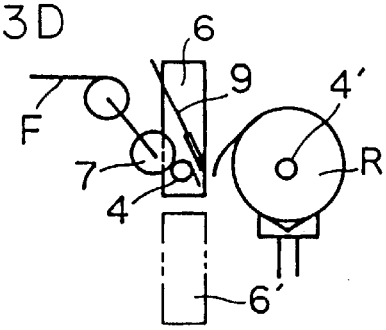
Figure 3E:
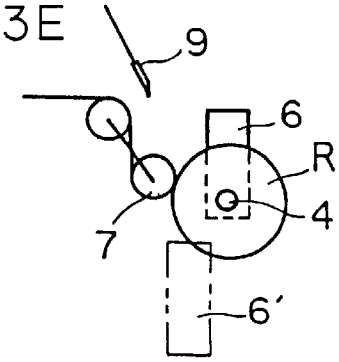

FIG. 3B shows the state that the film is nearly fully wound on the core of the lower-stage winding shaft 4' and moves backwards, concurrently with which the upper-stage winding shaft 4 located above is lowered to attach a next winding core. Thereafter, the lower-stage winding shaft 4' continues winding and the upper-stage winding shaft 4 is located in the winding position (FIG. 3C). At that time, the cutting blade 9 is lowered between the full roll R and the new core in the winding position to cut the film existing therebetween. The cut ends are, at the leading side, wrapped around a new winding core on the upper-stage winding shaft 4 and, at the trailing side, pressure-bonded to the full roll R, whereby the winding is stopped.

Figure 3F:
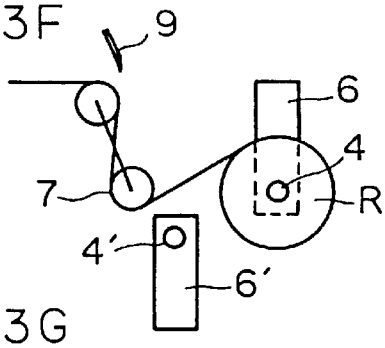
Figure 3G:
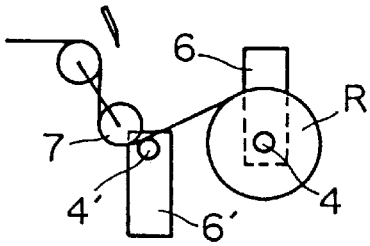

Subsequently, winding on the upper-stage winding shaft 4 is likewise conducted (FIG. 3E) and when a full winding is approached, the winding shaft 4 recedes (FIG. 3F). At that time, the lower-stage winding shaft 4' previously removed of the full roll R returns to the stand-by position and a new winding core is attached to the shaft 4'.

Figure 3H:
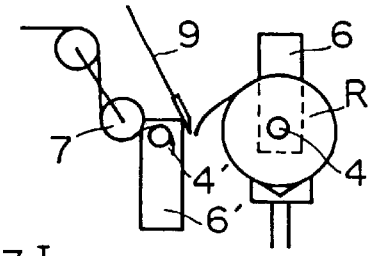
Figure 3I:
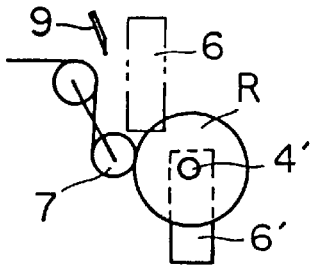
Figure 4A:
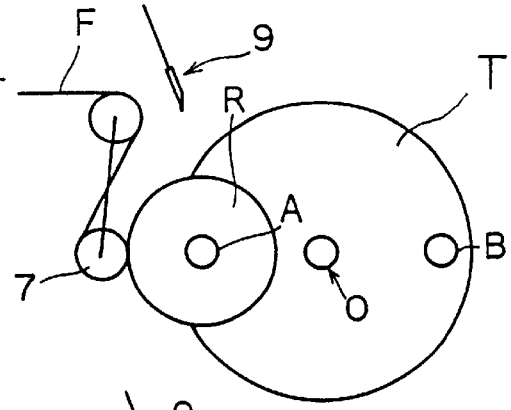
FIG.4A PRIOR ART
FIG. 4A to FIG. 4D are each an explanatory representation illustrating the roll changing operations in sequence according to a conventional two-shaft turret winder.
Figure 4B:
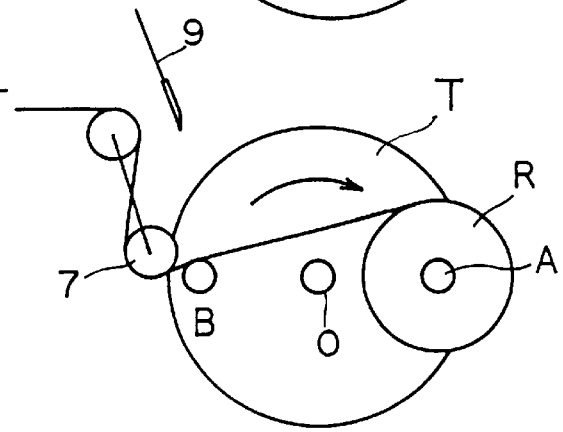
FIG.4B PRIOR ART
Figure 4C:
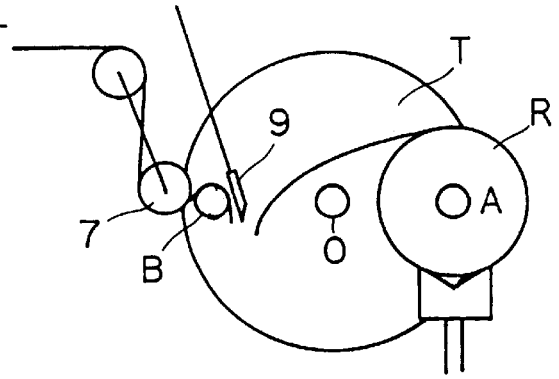
FIG.4C PRIOR ART
Figure 4D:
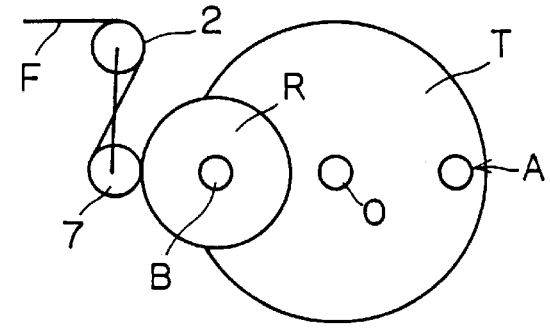
FIG.4D PRIOR ART

When the upper-stage winding shaft 4 is retreated while conducting the winding and the lower-stage winding shaft 4' holding the new core ascends to the winding position in this way (FIG. 3G), the cutting blade 9 descends between the full roll R on the upper-stage winding shaft 4 side and the new core on the lower-stage winding shaft 4' side to cut the film. The cut end of the running film is wrapped around the new core on the lower-stage winding shaft 4' while the cut end of the film on the full roll side is pressure-bonded to the roll. Thus the winding on the upper-stage winding shaft 4 is stopped (FIG. 3H).

A series of roll changing operations are finished in the foregoing sequence, and now, the lower-stage winding shaft 4' begins to perform the winding operation. When the shaft 4' approaches a full-winding state, the upper-stage winding shaft-holding members 6 are located in the stand-by position (FIG. 3I) and return to the initial stage (FIG. 3A).

The cycle of operations above is subsequently repeated, whereby winding and roll changing works are continuously performed.

Figure 6B:
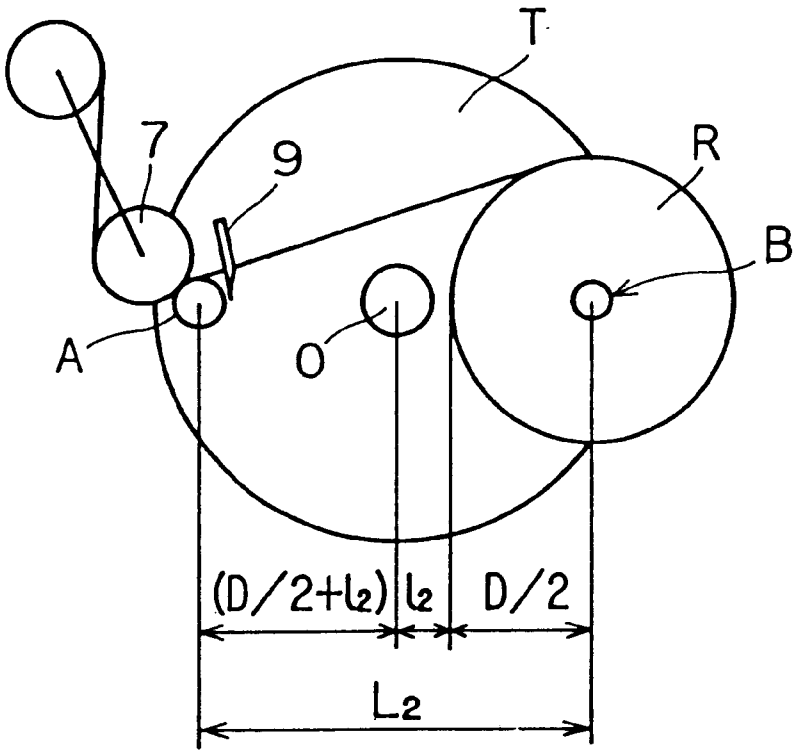
FIG.6B PRIOR ART
FIG. 6A and FIG. 6B are detailed comparative illustrations showing the film path distance upon roll changing with this invention and the conventional turret winder, respectively.

As described above, the present winder enables its driving system to be extremely simplified because of the foregoing roll changing operations, as compared with the conventional turret system. This will be described further in detail with reference to FIGS. 5 and 6: When the winding diameter is maximum, the distance between the winding shafts upon cutting and roll changing is a determinate distance $L_2$ for the turret system (FIG. 5B), while the distance is, for the present winder, a smaller distance $L_1$ merely required for cutting and roll changing (FIG. 5A). For instance, in FIG. 6, assuming that $l_1$: a distance required for cutting, $l_2$: a distance between a center axle O of the turret T and a maximum winding diameter not interfering with the center axle, d: an outside diameter of a winding core, D: a maximum winding diameter, then, $L_1$ and $L_2$ are expressed by: $L_1=d/2+D/2+l_1$, $L_2=2(l_2+D/2)$.

More specifically, for example, when $l_1=100$ mm, $l_2=100$ mm, d=90 mm, D=1200 mm are given, $L_1=90/2+1200/2+100=745$ mm and $L_2=2(100+1200/2)=1400$ mm.

Thus, the distance between a new core and a center axis of a winding shaft upon full winding is significantly reduced to 745 mm for the linear motion type winder according to this invention from 1400 mm for the conventional turret system.

Figure 6A:
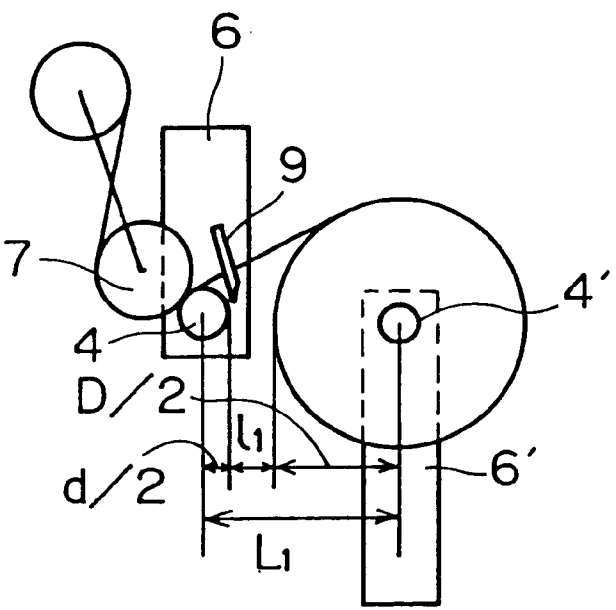

Further, where the winding diameter is smaller, the distance $L_2$ between center axes of winding shafts remains the same with the turret system (FIG. 5D), but with the linear motion type winder (FIG. 5C) the removal distance can be varied in conformity with the winding diameter and accordingly, stopped at the distance required for cutting, namely, the dimensional position of $\mathbf{1}_1$ in FIG. 6A, with the result that the film path distance between a new core and the winding shaft fully wound can be greatly shortened.

This fact signifies with an extensible film or the like that the shorter the film path distance upon roll changing is and the more the neck-in and wrinkling of the film are prevented, the shorter the roll changing cycle is. Consequently, the whole machine can be made compact and the cost can be greatly curtailed. This effect is remarkable, achieving a large cost down, particularly in the case of winding to a large diameter (1500 mm to 2000 mm).

Figure 7B:
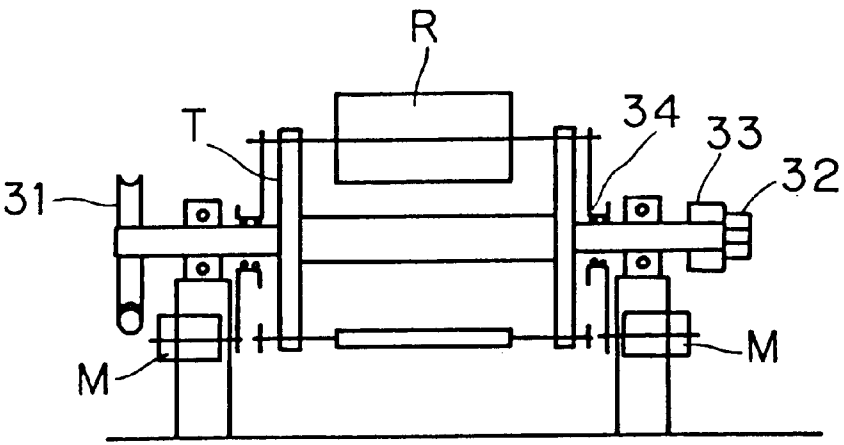
FIG.7B PRIOR ART
FIG. 7A and FIG. 7B are comparative illustrations showing the driving system with this invention and the conventional turret winder, respectively.

In the conventional turret system, since the winding shafts A, B are on the turret T (cf. FIG. 6B), winding motors M for respective winding shafts are mounted outside the winding frame and their powers are required to be transmitted through the shaft part of the turret T under revolution to the winding shafts, as shown in FIG. 7B. As a result, the transmission device is inevitably large-sized, causing a large mechanical loss of rotation and hence, the control of transmission torques required for the winding shafts poses a big problem. According to the linear motion type winder of this invention, however, it is possible to equip the winding frames 3,3' directly with winding motors $M_3$ (FIG. 7A) and consequently, the transmission device from each winding motor to each winding shaft is of a simple and small construction such that nearly avoids the occurrence of mechanical loss and makes it possible to control the winding torque with high precision.

Figure 7A:
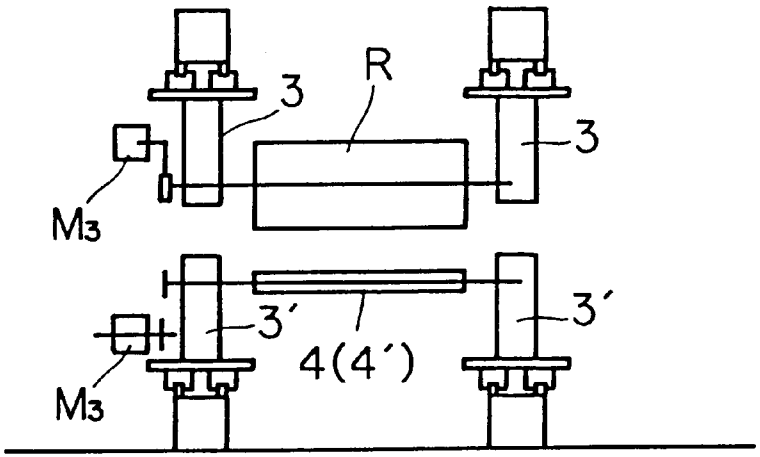

Furthermore, in the turret system as shown in FIG. 7B, pneumatic pipings and a variety of sensors in the turret T are required to be connected, passing through the main shaft fitted at one end with a worm gear 31 for turning, to the outside with the aid of a slip ring 33 and a rotary joint 32, etc. In contrast, according to this invention, because of the fact that there is no intersection between the upper-stage and lower-stage winding shafts, it is possible to connect the shafts directly to the outside from the respective winding frames 3,3' by means of linings and pipings, as shown in FIG. 7A, which enables a simplification and a large cost-down.

The invention has been so far described with one example of the winder, but it is naturally possible to change and modify the construction in various manner without departing from the scope and spirit of this invention.

According to the invention, the winder for sheet material is constructed so that winding shaft-holding parts are arranged independently above and below and fore and aft; and two winding shafts are moved linearly forwardly and backwardly and upward and downward to the extent that they don't interfere with each other, whereby the film continuously fed can be changed, upon cutting from the full roll on one winding shaft, to a new core on the other shaft. These are in sharp contrast to the conventional turret system. As a consequence, various noticeable effects can be attained as stated below:

(1) The distance between two winding shafts for a maximum winding diameter is longer than that for a small winding diameter by the difference between the maximum and small radii, (D−D')/2 (cf. FIGS. 5A and 5C), but still nearly a half as compared with the turret system (cf. FIGS. 5A and 5B).

Further, the distance between two winding shafts suffices to be a dimension required for cutting the film between a new core and the outer periphery of a full roll, and consequently, the film path length is constant irrespective of the winding diameter. Therefore, the moving distance of the winding shafts is short enough to make the overall machine compact. Further because the film path length upon roll changing is also shorter, the wrinkling and widthwise shrinkage of the film are also prevented or decreased. The fact that the displacement distance of winding shafts is shorter means that the movement time is shorter, with the result that the cycle time until roll changing is shortened.

(2) The winding shafts at upper and lower places of the main frames are independent of each other and winding motors can be mounted on respective winding frames. Because of that, the drive system is simplified, minimizing the mechanical loss, and the accuracy of control of winding torque is improved. Moreover, it is possible to install the motor, sensor, pneumatic pipings, etc. required for one winding shaft independently of those required for the other winding shaft, without using slip rings, etc.

Owing to salient features of the constructions above, it is thus possible to curtail vastly the production cost as compared with the conventional turret system.

What is claimed is:

1. A two-shaft linear motion type winder for winding up a film or the like which at least comprises:

an upper main frame and a lower main frame disposed in a diametrically opposed manner at a required distance spaced apart;

a pair of upper-stage winding frames provided with holding members for holding an upper winding shaft therebetween to be capable of ascending and descending vertically, each of the upper-stage winding frames being suspended from the upper main frame 50 as to be at least slidingly movable along the upper main frame in forward and backward directions between a winding position and a removal position of a full roll;

a pair of lower-stage winding frames provided with holding members for holding therebetween a lower winding shaft to be capable of ascending and descending vertically, each of the lower-stage winding frames being disposed on the lower main frame to face upwards so as to be at least slidingly movable along the lower main frame in forward and backward directions between the winding position and the removal position, the upper-stage and lower-stage winding frames and the holding members for the upper and lower winding shafts, respectively, being located to be individually movable back and forth, and up and down without interfering with each other;

a touch roller disposed in the vicinity of the winding position so that upon full winding, the full roll on the one winding shaft may be moved by press contact with the touch roller from the winding position to the removal position while the other winding shaft is moved to the winding position, thereby to attach a new winding core; and a cutting blade, disposed between the touch roller and the winding shaft, with which to sever the film running between the full roll and the new core, concurrently while wrapping a leading end of the film around the new core.

2. A two-shaft linear motion type winder as set forth in claim 1, wherein each of the pairs of upper-stage and lower-stage winding frames has a longitudinal slide mechanism therefor including threaded bars, nuts, and screw gearings; and each winding frame is provided with a vertical slide mechanism for a holding member including a linear rail and a slide member.

3. A two-shaft linear motion type winder as set forth in claim 1, wherein each of the holding members has a mechanism for elevating or lowering thereof including screw gearings, spline shafts, nuts, and threaded bars.

* * * * *